US005149189A

United States Patent [19]

Kawamura

[11] Patent Number: 5,149,189

[45] Date of Patent: Sep. 22, 1992

[54] LATERAL ILLUMINATED BUCKLE FOR VEHICLE SEAT BELT SYSTEM

[75] Inventor: Yoshihisa Kawamura, Shiga, Japan

[73] Assignee: Takata Corporation, Tokyo, Japan

[21] Appl. No.: 685,815

[22] Filed: Apr. 15, 1991

[30] Foreign Application Priority Data

Apr. 18, 1990 [JP] Japan ..... 2-102534

[51] Int. Cl.[5] ..... A44B 11/00; B60R 22/02; B60Q 1/00

[52] U.S. Cl. ..... 362/108; 362/32; 362/83.3; D11/201; D11/216; 24/633

[58] Field of Search ..... 362/108, 32, 61, 83.3, 362/103, 80, 362, 332, 311; D11/201, 216; D26/51; 24/633

[56] References Cited

U.S. PATENT DOCUMENTS 4,181,832 1/1980 Ueda ..... 362/61
4,237,586 12/1980 Morinaga ..... 362/103
4,283,756 8/1981 Beamon ..... 362/108
4,365,285 12/1982 Brundidge ..... 362/32

FOREIGN PATENT DOCUMENTS 3713528 11/1988 Fed. Rep. of Germany ..... 362/311

*Primary Examiner*—Ira S. Lazarus
*Assistant Examiner*—L. Heyman
*Attorney, Agent, or Firm*—Brumbaugh, Graves, Donohue & Raymond

[57] ABSTRACT

In an illuminated buckle for a seat belt system, an illuminating source is furnished in the buckle and a luminous cover section transmits the light from the illuminating source so as to emit light on the top and both lateral sides of the buckle main body. The lighted lateral sides of the buckle cover facilitate locating the buckle at night and also allow ready confirmation when the belt is not in place about the body of the occupant in a vehicle.

5 Claims, 4 Drawing Sheets

LATERAL ILLUMINATED BUCKLE FOR VEHICLE SEAT BELT SYSTEM

DESCRIPTION

BACKGROUND OF THE INVENTION

The present invention relates to a lateral illuminated buckle for vehicle seat belt systems and, in particular, to an illuminated buckle suitable for the seat belt system provided on the rear seat of the vehicle.

Seat belt systems are provided on the seats of a vehicle for restraining the body of the occupant in case of collision and for protecting the occupant from secondary impacts with internal parts of the vehicle. A seat belt is usually placed over the body by inserting a tongue on the belt into a buckle attached to the vehicle. At night and in other poorly illuminated conditions, however, it is frequently difficult to locate the buckle. This is especially troublesome in vehicle rear seats, where the belt buckles are often not located in fixed positions.

For these reasons, it has been proposed in the prior art to provide an illuminating device on the buckle and to illuminate the tongue inlet of the buckle so that it is visible in darkness.

For example, the Japanese Provisional Utility Model Publication No. 54-76818 discloses an arrangement to illuminate the pushbutton on the seat buckle. Japanese Patent Publications No. 55-30366 and No. 55-30367 and Japanese Utility Model Publications No. 57-22803 and No. 63-42809 disclose an arrangement to illuminate the edge of the tongue inlet of the buckle. Japanese Provisional Patent Publication No. 48-49126 discloses an arrangement to selectively illuminate the foregoing two components.

In all of these previously known arrangements, however, the end surface of the buckle is illuminated. Although illumination of the buckle end is effective when the buckle is supported by a stalk in an upright position, it is not satisfactory when the buckle is haphazardly placed on a seat or is upside down, as is often the case of the buckles in seat belt systems for the back seat. In such cases, it is not easy to visually locate the buckle even though lighted Moreover, lighting the end of the buckle is not suitable for practical application in some cases.

SUMMARY OF THE INVENTION

An object of the present invention is to provide an illuminated buckle for a seat belt system which can be readily seen, and located, even when the buckle is haphazardly placed or is in an inverted position.

The foregoing and other objects of the invention are attained by the provision of an illuminated buckle for a seat belt system in which an illuminating source is incorporated in the buckle in combination with a luminous, e.g., semi-transparent, cover section on at least the lateral sides, and preferably also the top, of the buckle body to transmit the light from the illuminating source. The illuminated buckle of the invention thus serves to enable the occupant to find the buckle in darkness and also affords ready visual confirmation when the seat belt is not in place about the body of the occupant, an important advantage in the case of children or handicapped passengers.

For a better understanding of the invention, reference may be made to the following description of exemplary embodiments, taken in conjunction with the accompanying drawings.

DESCRIPTION OF THE EXEMPLARY EMBODIMENT

Figure 1:
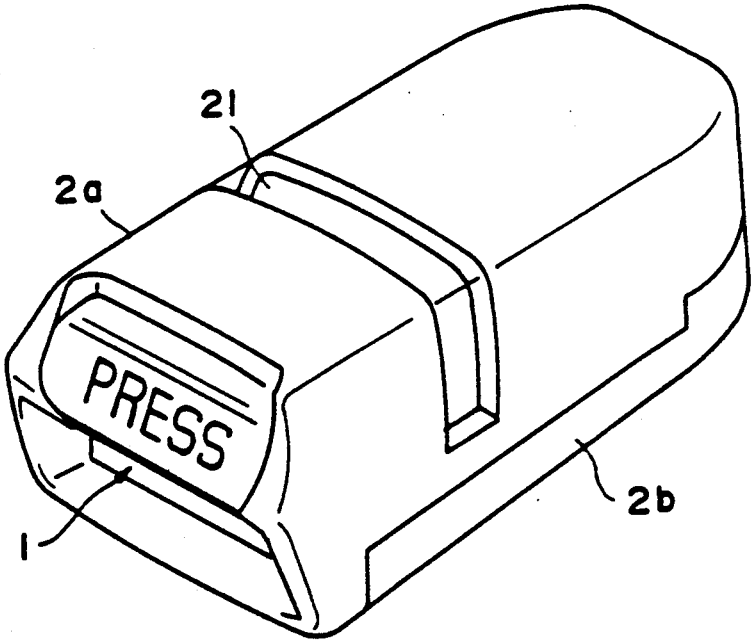
FIG. 1 is a perspective view of a first embodiment of an illuminated buckle according to the present invention.

As shown in FIG. 1, the buckle comprises a buckle main body 1 having a two-piece upper cover 2*a* for covering all sides except the front side and a lower cover 2*b*. An illuminating source, as described hereinafter, is provided within the buckle main body 1 for transmitting light through a luminous cover section 21. In accordance with the invention, the luminous cover section 21 extends over the top surface and portions of both lateral sides of the upper cover 2*a* . Preferably, the luminous section 21 is made of semi-transparent light-transmitting material.

Figure 2:
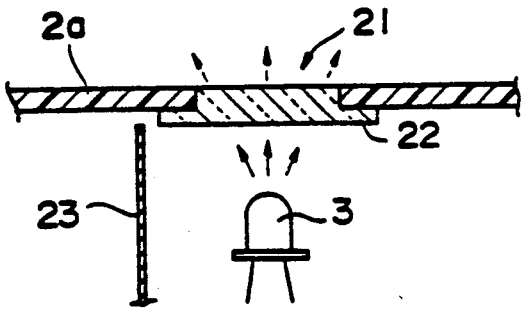
FIG. 2 is a partial schematic cross-sectional view of one arrangement of an illuminating source and associated luminous cover section.

In the embodiment of FIG. 2, the luminous cover section 21 consists of a semi-transparent luminous member 22 integrated with the upper cover 2*a* by double molding. When light is irradiated from the back side from the illuminating source 3, preferably a light emitting diode (LED), the entire luminous member 22 glitters. As the member 22 extends over the top and on the lateral sides of the buckle body, the buckle is easily seen even if upside down. If desired, a shield plate 23 may be provided as necessary on the cover 2*a* or on the buckle main body 1 to prevent the light from leaking through other openings of the buckle. The luminous member 22 may be given a decorative or colorized finish to enhance the appearance and visibility of the buckle.

Figure 3:
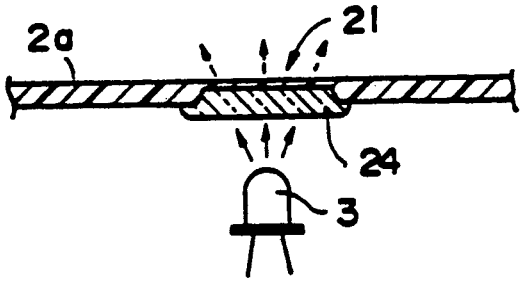
FIG. 3 is a partial schematic cross-sectional view of another arrangement of an illuminating source and associated luminous cover section.

In the embodiment of FIG. 3, a portion 21 of the upper cover 2*a* is made thinner, and a transparent light transmitting member 24 is integrated with it on the back side of the thinner portion by double molding. In the other details, the arrangement is the same as that of the embodiment of FIG. 2. In the FIG. 3 embodiment, the light coming through the light transmitting member 24 passes through the thinned upper cover 2*a* and escapes from the buckle, thereby providing the required illumination. Therefore, according to the arrangement of this second embodiment, an illuminating buckle can be provided without changing the external appearance of the surface of the buckle cover. This is especially advantageous when it is desired to maintain the overall appearance of the buckle body when it is not illuminated.

Figure 4:
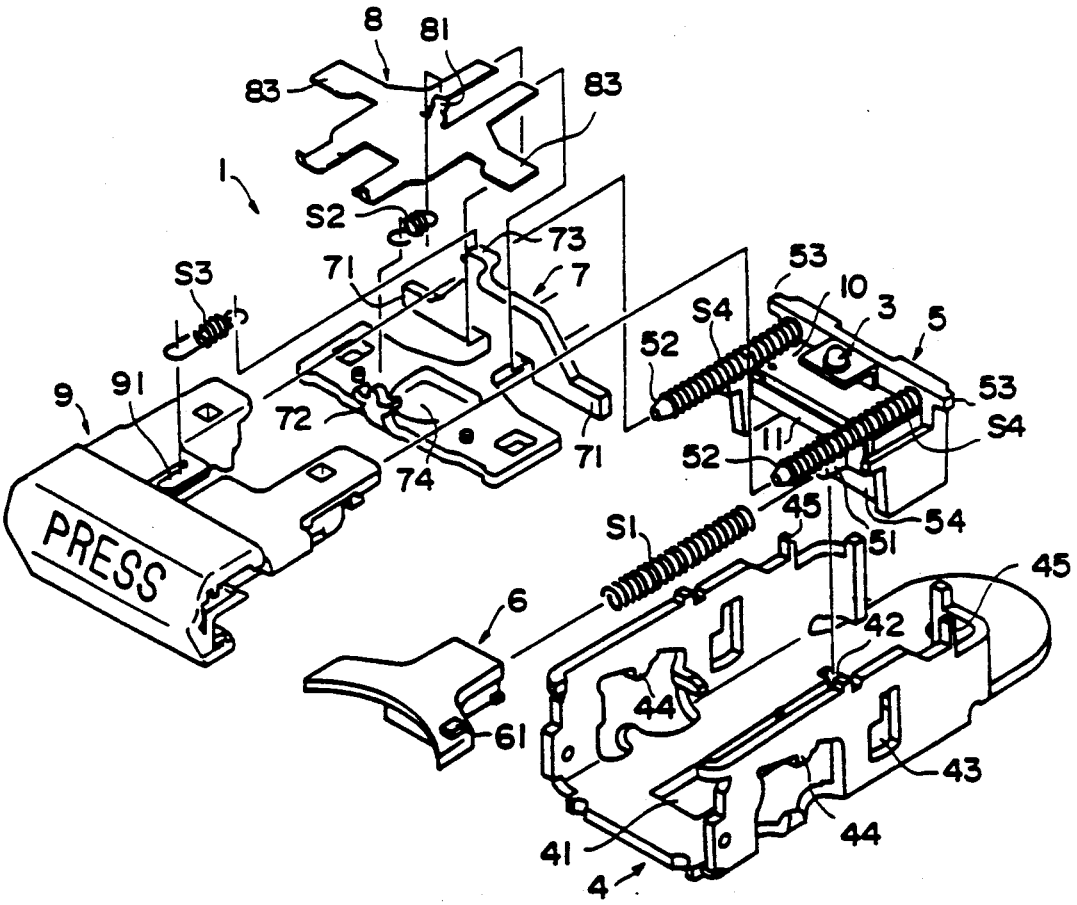
FIG. 4 is an exploded view showing the internal structure of one embodiment of an illuminated buckle according to the invention.

FIG. 4 is an exploded view of an illustrative embodiment of the internal structure of a belt buckle incorporating the aforementioned illumination features of the invention. In FIG. 4, the buckle main body 1 includes a grooved buckle base 4 (hereinafter referred to as "base"), an ejector 6 engaged in a longitudinal slit 41 formed on the bottom wall and sliding along the base 4 in longitudinal direction, and a spring holder 5 having its lower projection 54 engaged in a lateral slit 42 continuous to the rear end of the longitudinal slit 41 of the base 4. (Hereinafter, the belt mounting side at the right in FIG. 4 is called "rear" and the left side is called "front" for clarity in describing the arrangement of the buckle.) The left and right projections 53 on the rear end of the spring holder 5 are brought into contact with the lateral wall projections 45 of the base 4. A push-out spring S1 is placed over a projecting shaft 51 protruding in front-back direction from the spring holder 5, with one end thereof supported on the front surface of the spring holder 5 and the other end thereof in contact with the bottom of the front-back bore in the ejector 6 [see FIG. 5A]. A latch plate 7 with a pivotal arm 71 is engaged in a lateral wall opening 43 of the base 4 and is movably mounted on the base 4, being prevented from falling by the front edge of the spring holder 5. A lock plate 8 is supported by overlapping on the upper surface of the latch plate 7. A pushbutton 9 is placed over the latch plate 7 and the lock plate 8, a tension spring 52 extends between the front projection 72 of the latch plate 7 and the rear projection 81 of the lock plate 8, and a tension spring S3 extends between the spring support projection 91 on the top of the pushbutton 9 and the rear projection 73 of the latch plate 7. Compression return springs S4 have one end thereof engaged over the shafts 52 protruding forward from the spring holder 5 and touching the front surface of the spring holder 5 and the other end thereof in contact with the bottom of the rearly opening bores in the pushbutton 9.

In the buckle main body 1 of FIG. 4, an illuminating source 3 according to the present invention, e.g., an LED, is mounted on the front side of the spring holder 5, with the lead terminal 12 mounted on the rear side (see FIG. 5). The lead wire (not shown) connected to the lead terminal 12 may be guided toward the back of the base 4 through any suitable route.

In the embodiment of FIG. 4, provision is made to turn the light source off when the buckle is used, i.e., when the tongue is inserted. For that purpose, a microswitch 10 is supported on the front surface of the spring holder 5, and the free end of the switch segment 11 to open or close electrical contact is placed face-to-face to the rear end surface of the projection 61 on the top of the ejector 6.

The electrical connections leading to the light emitting diode and microswitch are not shown in FIG. 4, but preferably they are connected in series to each other and to the vehicle power source through a load resistance which reduces the voltage applied on the diode. Such connections may be conventional and are well understood in the art.

Figure 5A:
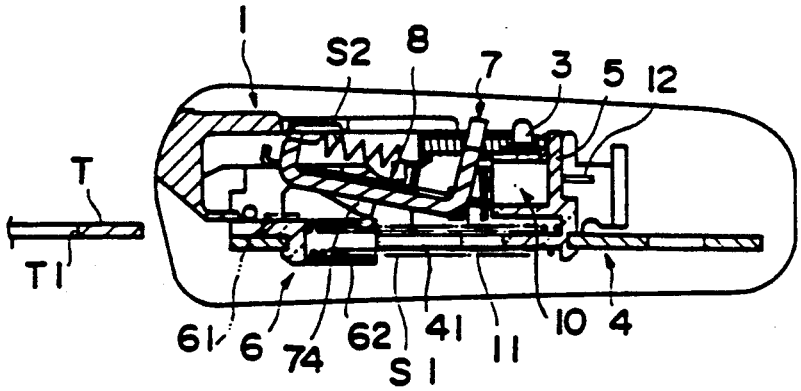
FIGS. 5A and 5B are cross-sectional views showing the embodiment of FIG. 4 with the belt tongue removed and inserted, respectively.

As depicted in FIG. 5A, when the tongue T is not inserted in the buckle 1, the ejector 6 is at the most advanced position, i.e., with the front surface of the sliding segment 62 in contact with the front end of the longitudinal slit 41. In this condition, the latch plate 7 is pushed upward by engagement of the projection 74, which upon insertion of the tongue T engages with the opening T1 of the tongue T, with the upper surface of the ejector 6. The lock plate 8 is moved backward against the force of the tension spring S2, and the front edge of the wing portion 83 is in contact with the rear cam surface of the projection 74 protruding downward from the edge of the opening formed on the lateral wall of the base 4. Under this condition, the segment 11 of the switch 10 is pushed forward, and the contact of the switch is turned on. Accordingly, the illuminating source 3 is in the state to emit the light, and the top and lateral sides of the buckle are illuminated.

Figure 5B:
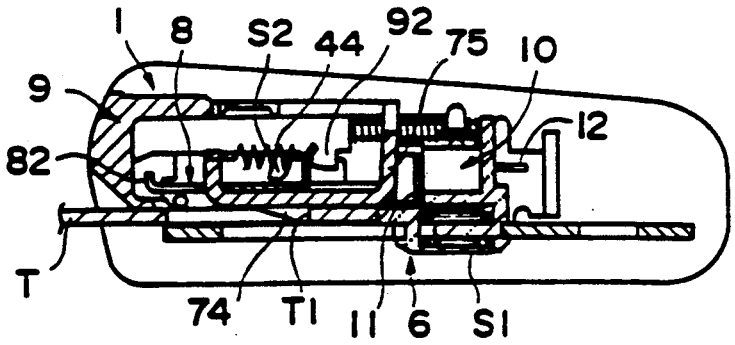

When the tongue T is inserted in the buckle, as shown in FIG. 5B, the ejector 6 is engaged by the front edge of the tongue T and moves backward against the push-out spring S1. When the edge of the opening T1 of the tongue T passes beyond the lower projection 74 of the latch plate 7, the restraint of the upward movement of the latch plate 7 to hinder forward movement of the lock plate 8 is released. The lock plate 8 is then moved to the forward position shown in FIG. 5B by the tension spring S2. When the front edge of the wing portion 83 of the lock plate 8 rides over the rear cam surface of the projection 74, the front portion of the latch plate 7 is pushed downward by reaction force and is moved counterclockwise. The lower projection 74 of the latch plate 7 enters the opening T1 and holds the tongue in a locked state. In this case, the segment 11 of the switch 10 is pushed backward by the projection 61 of the ejector 6, and the switch 10 is opened. As a result, the illuminating source 3 is turned off.

When the pushbutton 9 is pushed to remove the tongue T, the rear surface of the pushbutton is brought into contact with the front edge 82 of the lock plate 8 and pushes the plate 8 backward against the tension spring S2. When the front edge of the wing 83 reaches the position to be separated from the projection 74, the projection 92 of the push button 9 strikes the vertical wall 75 at the rear end of the latch plate 7, which causes the latch plate 7 to pivot clockwise around the pivotal arm 71. The engagement of the opening T1 of the tongue T with the projection 74 is thereupon released, and the ejector 6 is urged forward by the push-out spring S1. This causes the tongue T to be ejected from the buckle. As a result of this action, the segment 11 of the switch 10 is pushed out, and the internal contact returns to ON status, as shown in FIG. 5A.

According to the arrangement of FIGS. 5A and B, the lateral sides of the buckle emit light when not engaged about the body of the occupant, thus making it easy to locate the buckle even if it is thrown carelessly on the seat. Also, as shown in FIG. 4 and FIG. 5, the spring holder 5 is used as a support for the illuminating source 3 and the switch 10, so that the invention can be readily incorporated into conventional buckles without substantial modification of the buckle structure.

Although the invention has been described hereinabove in connection with specific embodiments thereof, it will be understood that such embodiments are susceptible of modification and variation without departing from the inventive concept disclosed. For example, more than one illuminating source may be used and different illuminating colors may be employed. Besides the self-illuminating light emitting diode, electric lamp, etc., the tip of a non-light-emitting light conductive member may be used. In this case, the tip of an optical fiber may be placed in the buckle, and the light source may be furnished outside the buckle. If desired, the electrical lead wires and/or optical fiber associated with the illuminating source and/or switch may be woven or otherwise incorporated into the belt webbing so as to minimize any hindrance in the use of the seat belt. All such modifications and variations, therefore, are intended to be incorporated within the spirit and scope of the appended claims.

I claim:

1. An illuminated buckle for a seat belt system comprising a releasable latch mechanism for receipt of a buckle tongue having opposite side edges and top and bottom faces, the latch mechanism including a lateral side located opposite each side edge of the buckle lateral side located opposite each side edge of the buckle tongue and a top side located opposite the top face of the buckle tongue, cover means for covering at least the top and lateral sides of the latch mechanism, an illuminating source located within said cover means, and light-transmitting means on at least the lateral sides of said cover means for transmitting light from the illuminating source.

2. An illuminated buckle according to claim 1 wherein said light transmitting means comprises a light-transparent section of said cover means.

3. An illuminated buckle according to claim 2 wherein said light-transparent section comprises a semi-transparent member incorporated in said cover means.

4. An illuminated buckle according to claim 2 wherein said light-transparent section comprises a thinned down section of said cover means and a semi-transparent member underlying said thinned down section.

5. An illuminated buckle according to claim 1 and further comprising switch means responsive to the insertion of said tongue into the latch mechanism for turning off said illuminating source.

* * * * *

UNITED STATES PATENT AND TRADEMARK OFFICE

CERTIFICATE OF CORRECTION

PATENT NO. : 5,149,189

DATED : Sept. 22, 1992

INVENTOR(S) : Kawamura

It is certified that error appears in the above-identified patent and that said Letters Patent is hereby corrected as shown below:

Col. 5, bridging lines 6 and 7, delete "lateral side located opposite each side edge of the buckle".

Signed and Sealed this

Thirtieth Day of November, 1993

Bruce Lehman

*Attest:*

BRUCE LEHMAN

*Attesting Officer*

*Commissioner of Patents and Trademarks*